US010245210B2

(12) United States Patent
Kim

(10) Patent No.: US 10,245,210 B2
(45) Date of Patent: Apr. 2, 2019

(54) WHIRLPOOL SPA MOTOR PUMP OF WHIRLPOOL MASSAGE BATHTUB

(71) Applicant: J&A USA Inc., Brentwood, NY (US)

(72) Inventor: YunHo Kim, Dix Hills, NY (US)

(73) Assignee: J&A USA INC., Brentwood, NY (US)

( * ) Notice: Subject to any disclaimer, the term of this patent is extended or adjusted under 35 U.S.C. 154(b) by 92 days.

(21) Appl. No.: 15/452,947

(22) Filed: Mar. 8, 2017

(65) Prior Publication Data

US 2017/0290737 A1 Oct. 12, 2017

(51) Int. Cl.

| | |
|---|---|
| ***A61H 33/00*** | (2006.01) |
| ***F04D 1/06*** | (2006.01) |
| ***F04D 13/06*** | (2006.01) |

(52) U.S. Cl.

CPC ..... *A61H 33/0087* (2013.01); *A61H 33/6063* (2013.01); *A61H 33/6073* (2013.01); *F04D 1/06* (2013.01); *F04D 13/06* (2013.01); *A61H 2201/1207* (2013.01)

(58) Field of Classification Search

CPC ..... A61H 33/0087

USPC ..... 4/541.1–541.6, 622

See application file for complete search history.

(56) References Cited

U.S. PATENT DOCUMENTS 7,111,334 B2 9/2006 Chen
8,272,079 B2 9/2012 Long

*Primary Examiner* — Christine Skubinna
(74) *Attorney, Agent, or Firm* — Hoffmann and Baron, LLP

(57) ABSTRACT

The present invention relates to a whirlpool bathtub, in which the mounting structure of a whirlpool spa motor pump is improved such that the attachment and detachment of the whirlpool spa motor pump can be conveniently carried out inside the bathtub. To this end, the present invention includes a lower housing having an upper flange and a lower flange, an impeller for rotating by a motor, which is provided to the lower housing, so as to generate suction force, an upper housing coupled to an upper portion of the lower housing by a coupling means and having a suction holes and a discharge holes, two or more slider rails vertically provided on the outside of the lower housing, a mounting bolt provided to the upper and lower flanges, so as to be positioned at one side of the slider rail, a slider fitted with the mounting bolt, and a slider holder inserted into the slider so as to be screw-coupled with the mounting bolt.

16 Claims, 17 Drawing Sheets

WHIRLPOOL SPA MOTOR PUMP OF WHIRLPOOL MASSAGE BATHTUB

BACKGROUND

This application claims priority to Korean Patent Application No. KR20160034854 filed Mar. 23, 2016, the disclosure of which is incorporated herein by reference.

FIELD OF THE INVENTION

The present invention relates to a whirlpool bathtub and, more particularly, to a whirlpool spa motor pump of a whirlpool massage bathtub, in which the mounting structure of a whirlpool spa motor pump is improved such that the attachment and detachment of the whirlpool spa motor pump can be conveniently carried out inside the bathtub.

BACKGROUND ART

In general, a whirlpool bathtub is a bathtub, in which water of high pressure and bubbles are jetted to the inside of the bathtub while circulating water so as to provide water jet massage to the skin of a user, thereby providing massage effect and skin care effect by using the water.

Recently, the use of such a whirlpool bathtub having good functions of the massage, skin care and the like has been rapidly increased due to the improvement in the standards of living and the increasing interest in health.

In general, such a whirlpool bathtub has a drain hole in the bottom surface so as to discharge water after use in the same manner as a normal bathtub.

In addition, the whirlpool bathtub has a whirlpool spa motor pump (hereinafter, referred to as "a pump") provided to a wall in the bathtub, wherein the pump functions to suck the water in the bathtub and then discharge the same with vortex by applying predetermined pressure thereto, thereby inducing massage effect.

FIG. 1 is an exploded perspective view showing a prior art whirlpool spa motor pump, FIG. 2 is a cross-sectional view showing the assembled state of FIG. 1, and FIG. 3 is a schematic diagram for explaining water streams formed by the rotation of a rotor.

According to the prior art, the pump includes a stator 3 incorporated and having a post 2, a lower housing 1 having a male screw part 4 formed on the outer circumferential surface at one side, a rotor 7 assembled into the post 2 of the stator 3 and having a plurality of vanes 5 provided in the radial direction on the outer circumferential surface of the rotor 7, and a central bore 6 formed in the center of the top surface of the rotor 7 so as to suck water, an upper housing 10 coupled to the lower housing 1 by a coupling means and having a suction hole 8 formed in the center so as to suck water and a plurality of discharge holes 9 formed in the periphery of the suction hole 8 so as to discharge the sucked water, a packing 12 and a seal 13 respectively provided to the front and rear surfaces of the bathtub 11 so as to maintain airtightness, and a coupling cap 15 having a female screw part 14 screw-coupled to the male screw part 4 of the lower housing 1.

Therefore, if the rotor 7 rotates in a state, in which the pump P is provided to the bathtub 11, as shown in FIG. 2, then the water in the bathtub is sucked into the lower housing 1 through the suction holes 8, which is formed in the center of the upper housing 10, as shown by a thick solid line in FIG. 3.

Thus sucked water spreads in the radial direction by the vanes 5 formed on the rotor 7 and is discharged through the discharge holes 9, which are formed in the periphery of the suction hole 8, along the direction indicated by the arrows of thin solid lines after colliding with the inner wall of the lower housing 1, such that the skin of a user is hit by the water jets and thus provided with massage effect using the water.

SUMMARY

However, the prior art pump in the above structure has several problems, which will be described hereinafter.

Firstly, since the pump is provided to a bathtub in such a manner the lower housing is assembled into the bathtub from the front surface of the bathtub and then the lower housing is screw-coupled with the coupling cap so as to mount the pump to the bathtub from the rear surface of the bathtub, the pump has a fatal defect that the pump once provided to the bathtub cannot be disassembled from the bathtub in the case of repair and the like of the pump and thus the bathtub itself has to be inevitably disassembled in order to separate the pump from the bathtub.

Secondly, since the pump has no structure for draining leaked water when water leakage is generated from a mechanical seal due to the long term use of the pump, the pump may induce electrical shock.

Thirdly, since the coupling cap has to be turned to be fixed, there is a limit in the stable fixing of the pump with respect to the bathtub and thus the coupling state of the pump is likely to be loosened due to vibration and the like resulted from repetitive use of the pump.

Accordingly, the present invention has been made to solve the above-mentioned problems occurring in the prior arts, and it is an objective of the present invention to provide a whirlpool spa motor pump of a whirlpool massage bathtub, in which the structure of the pump is improved such that the pump can be easily fixed to a whirlpool bathtub from the front surface thereof and the attachment and detachment of the pump with respect to the whirlpool bathtub can be simplified.

It is another objective of the present invention to provide a whirlpool spa motor pump of a whirlpool massage bathtub, in which the structure of a pump housing is improved such that the pump can be simplified, thereby reducing manufacturing costs.

To accomplish the above objectives, according to one aspect of the present invention, there is provided a whirlpool spa motor pump of a whirlpool massage bathtub, comprising a lower housing having an upper flange and a lower flange, an impeller for rotating by a motor, which is provided to the lower housing, so as to generate suction force, an upper housing coupled to an upper portion of the lower housing by a coupling means and having suction holes and discharge holes, two or more slider rails vertically provided on the outside of the lower housing, a mounting bolt provided to the upper and lower flanges so as to be positioned at one side of the slider rail, a slider fitted with the mounting bolt, and a slider holder inserted into the slider so as to be screw-coupled with the mounting bolt.

According to the present invention, the whirlpool spa motor pump of a whirlpool massage bathtub as described above has several advantages, which will be described hereinafter.

Firstly, the mounting of the pump is finished in such a manner that the pump is passed through a hole formed in the bathtub from the front surface of the bathtub and then the mounting bolt is idled in a direction by using a tool such as a driver and the like. To the contrary, in order to release the pump, the clamping of the pump is simply released by idling the mounting bolt in the opposite direction. Therefore, in the case of repair or management of the pump, it is not necessary to disassemble the bathtub at all.

Secondly, even though water leakage is generated from a mechanical seal due to the long term use of the pump, the water introduced to the inside of the lower housing is discharged to the outside through drain holes, thereby preventing any electric shock resulted from the water leakage beforehand.

Thirdly, the slider rail has a concave groove portion and the slider is movably coupled to the slider holder when mounting the pump. Therefore, since the slider is positioned on the concave groove portion at the bottom dead point thereof and connected to the vertical surface of the slider rail at the top dead point thereof, the size of a hole formed in the bathtub for the coupling of the pump can be minimized.

Fourthly, since the slider is lifted and comes into close contact with the bathtub by idling the mounting bolt by using a tool such as a driver and the like, the pump can be stably provided to the bathtub.

Fifthly, slider feet are fixed on the top surface of the extension parts of the slider such that the pump can be more stably provided.

DETAILED DESCRIPTION

Figure 1:
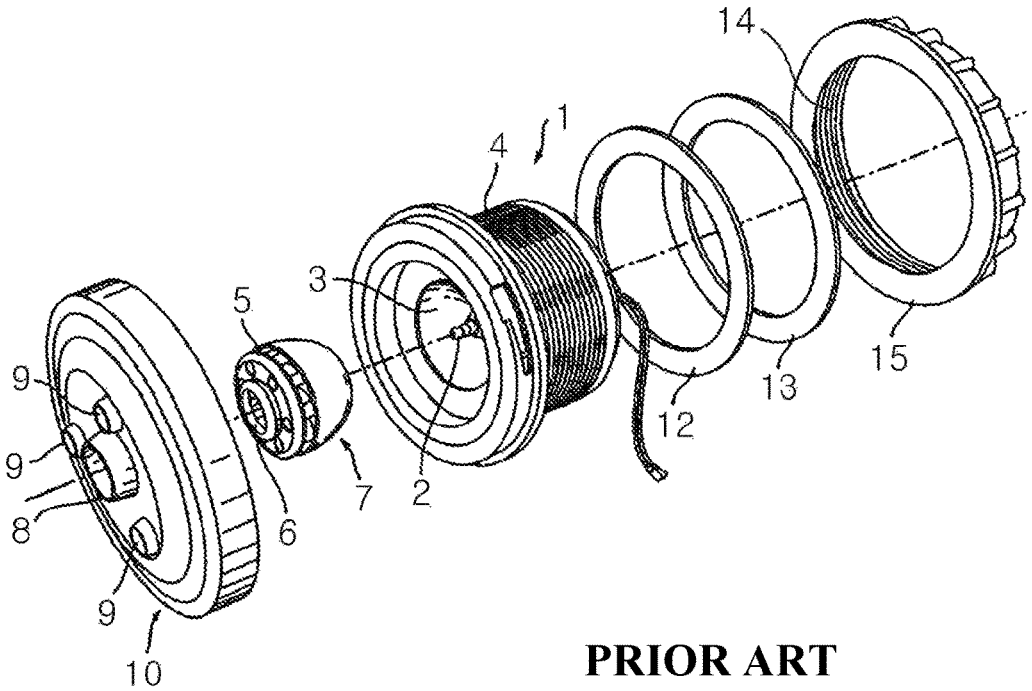
PRIOR ART FIG. 1
FIG. 1 is an exploded perspective view showing a prior art whirlpool spa motor pump.
Figure 2:
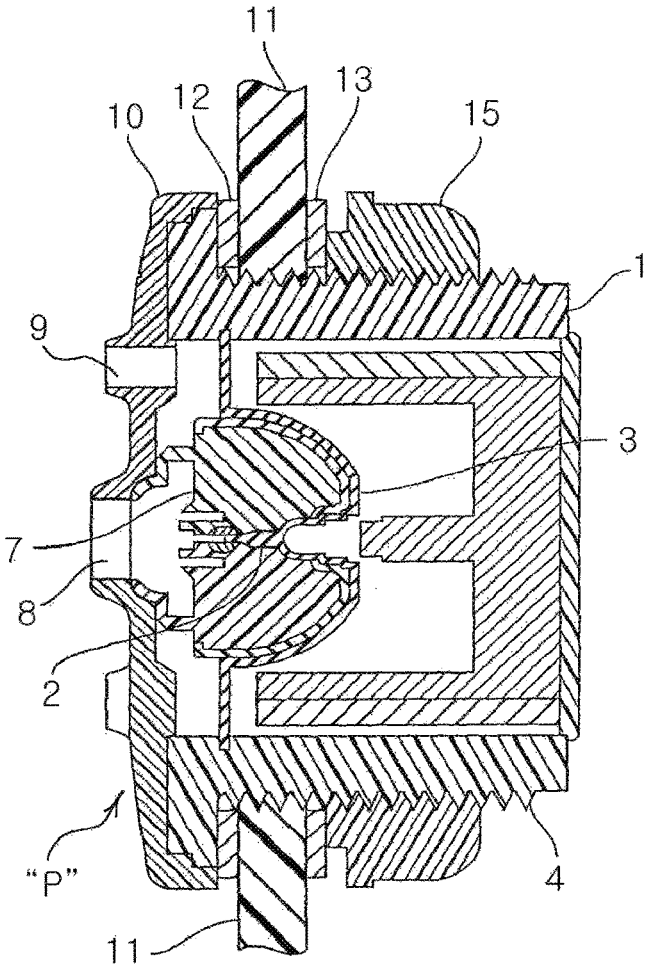
PRIOR ART FIG. 2
FIG. 2 is a cross-sectional view showing the assembled state of the pump shown in FIG. 1.
Figure 3:
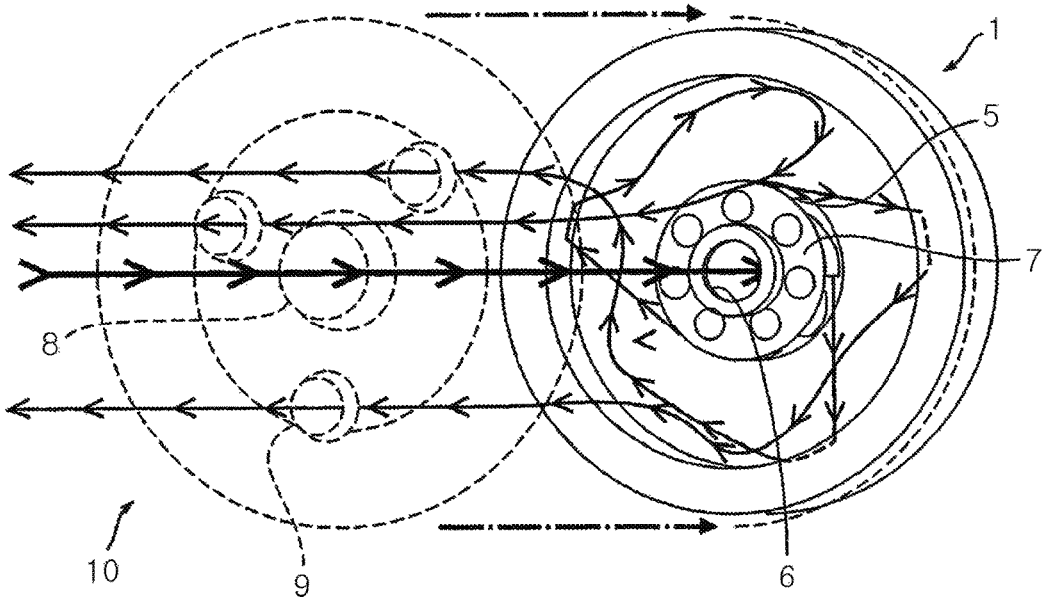
PRIOR ART FIG. 3
FIG. 3 is a schematic diagram for explaining water streams formed by the rotation of a rotor.

Hereinafter, reference will be now made in detail to the preferred embodiments of the present invention with reference to the attached drawings in a manner that the invention can be readily carried out by a person skilled in the art. The present invention could be implemented in many other various forms and is not limited by the example embodiments which will be described in the following. It should be noted that the drawings are schematic but not drawn in scale. In the attached drawings, relative measurements and proportions of the components are more enlarged or reduced than they actually are in order to clarify the present invention and a certain measurement is just illustrative but not limitative. In the drawings, the same structures, elements or components have the same reference numerals even though they are illustrated in different figures.

Figure 4:
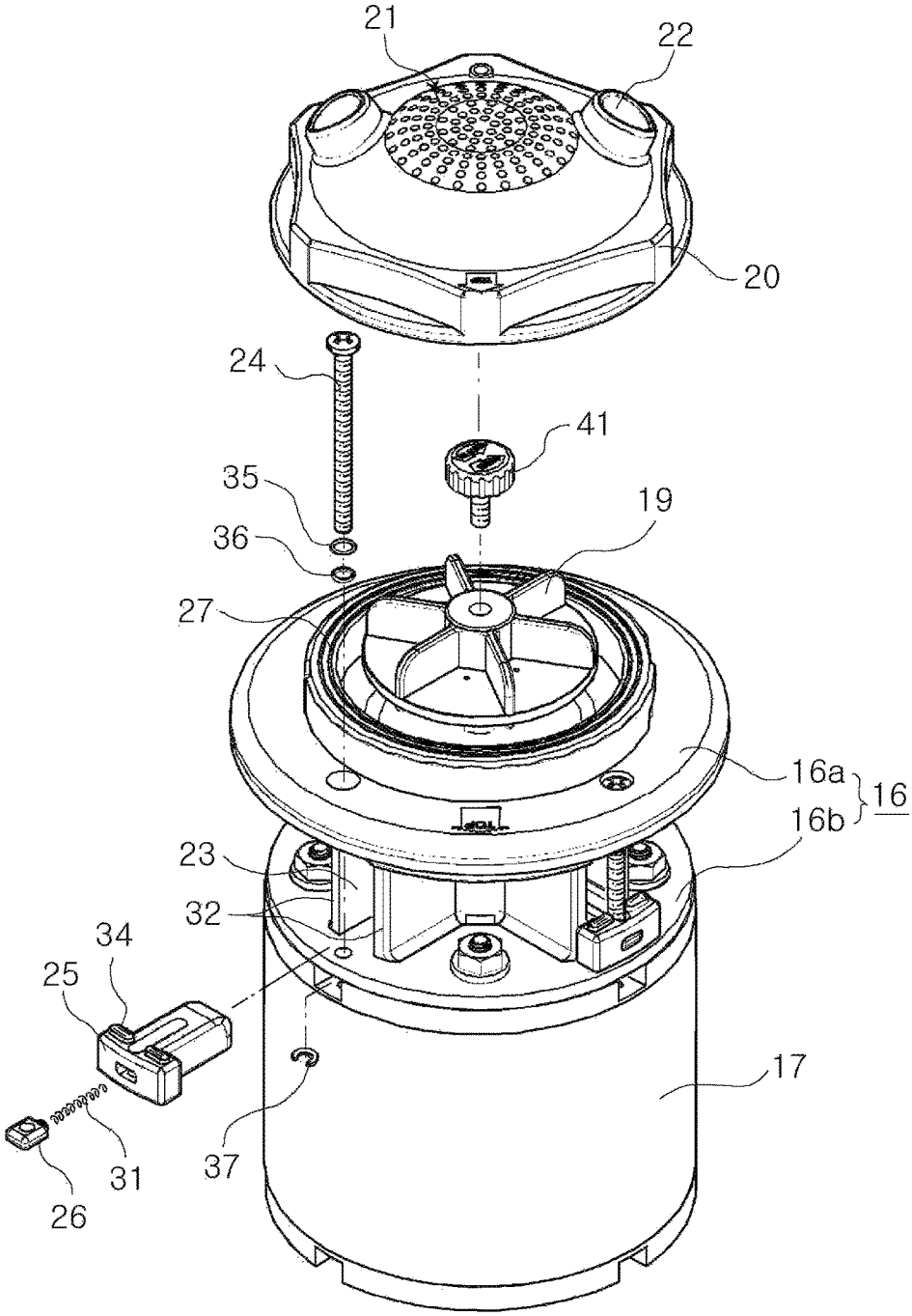
FIG. 4 is an exploded perspective view showing the structure of a whirlpool spa motor pump of a whirlpool massage bathtub according to a first embodiment of the present invention.
Figure 5:
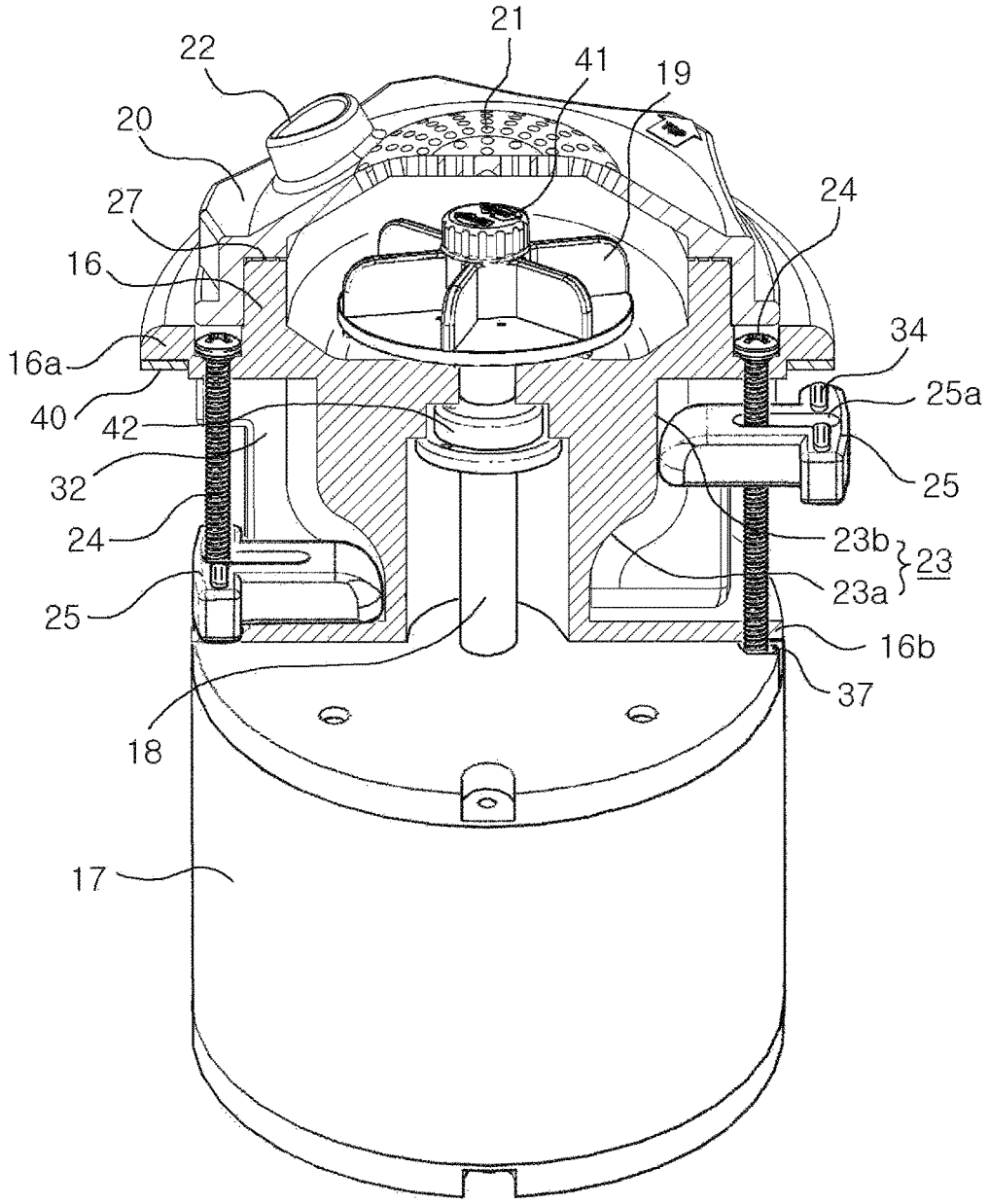
FIG. 5 is a perspective view showing the cross-sections of upper and lower housings in the assembled state of the pump shown in FIG. 4.
Figure 6:
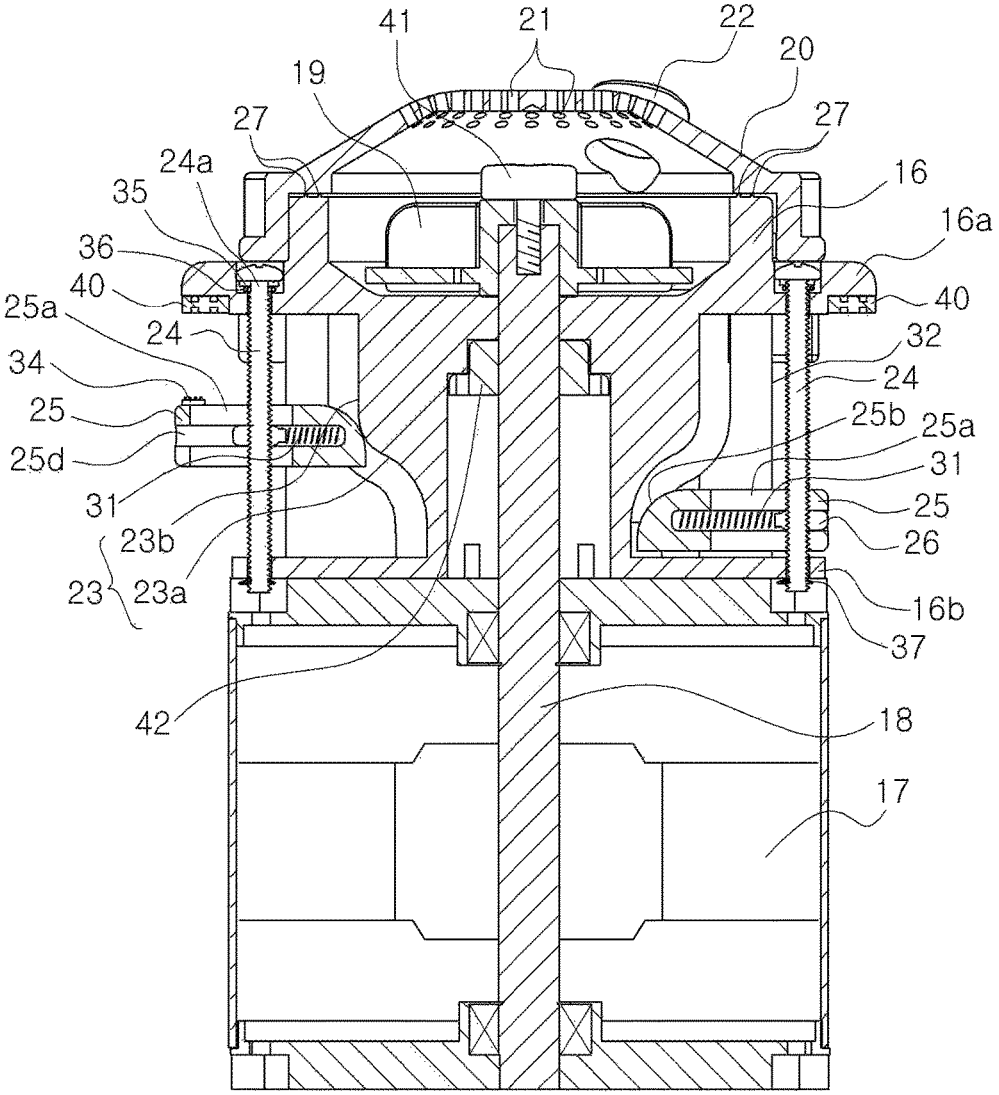
FIG. 6 is a cross-sectional view of the pump according to the present invention.

FIG. 4 is an exploded perspective view showing the structure of a whirlpool spa motor pump of a whirlpool massage bathtub according to a first embodiment of the present invention, FIG. 5 is a perspective view showing the cross-sections of upper and lower housings in the assembled state of the pump shown in FIG. 4, and FIG. 6 is a cross-sectional view of the pump according to the present invention. Referring to FIG. 4 to FIG. 6, a whirlpool spa motor pump of a whirlpool massage bathtub, according to the present invention, includes a lower housing 16 having an upper flange 16*a* and a lower flange 16*b*, an impeller 19 for generating suction force as a shaft 18 is rotated by a motor 17, which is provided to the lower housing 16, an upper housing 20 coupled to an upper portion of the lower housing 16 by a coupling means and having suction holes 21 and discharge holes 22, two or more slider rails 23 vertically provided on the outside of the lower housing 16, a mounting bolt 24 provided to the upper and lower flanges 16*a*, 16*b* so as to be positioned at one side of the slider rail 23, a slider 25 fitted with the mounting bolt 24, and a slider holder 26 inserted into the slider 25 so as to be screw-coupled with the mounting bolt 24.

Figure 8:
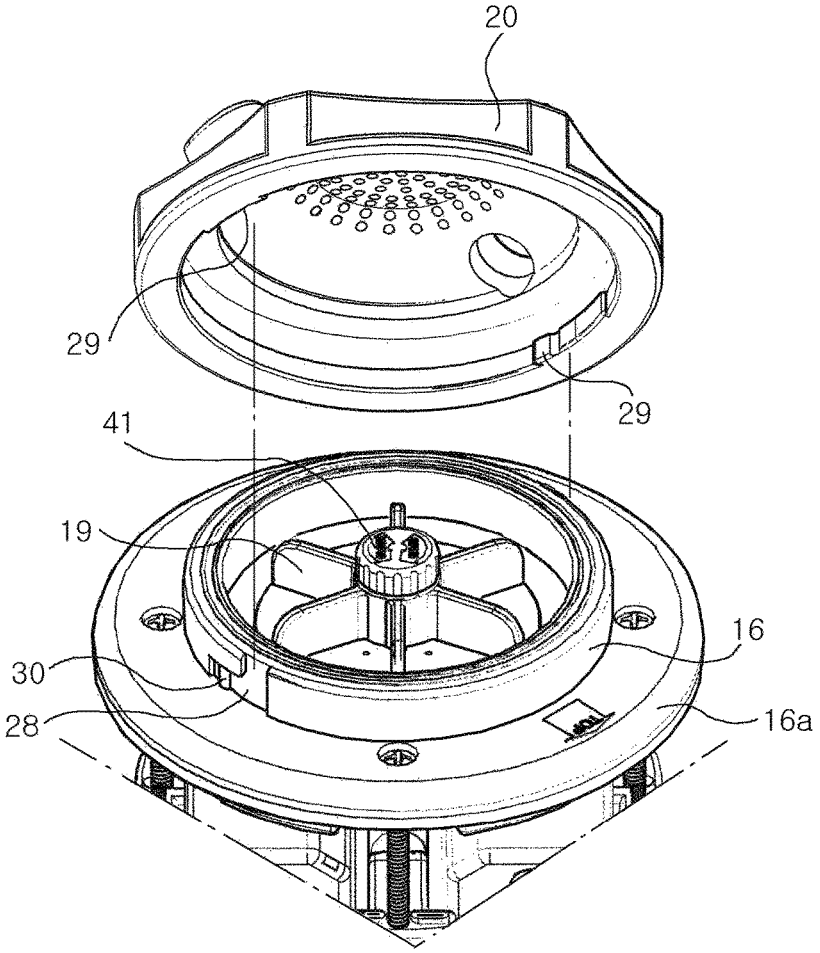
FIG. 8 is an exploded perspective view for explaining the assembling structure of the upper and lower housings according to the present invention.

At least one or more sealing rings 27 are formed on the top surface of the lower housing 16 so as to maintain the airtightness with respect to the upper housing 20, wherein the upper and lower housings 16 and 20 are coupled to each other so as to be opened or closed with respect to each other by the coupling means. As for the coupling means, as shown in FIG. 8, at least one or more coupling grooves 28 are formed on the upper circumferential surface of the lower housing 16 and coupling protrusions 29 are formed on the inner circumferential surface of the upper housing 20 such that the coupling protrusions 29 are fitted and held on the coupling grooves 28, wherein the coupling grooves 28 are provided with holding protrusions 30 for preventing the escape of the coupling protrusions 29.

According to the first embodiment of the present invention, four slide rails 23 are formed with a phase difference of 90° on the lower housing 16 and each of the slide rails 23 is provided with the slider 25 such that the sliders 25 can be lifted or lowered along the slide rails 23.

Of course, the slider holders 26, to which the mounting bolts 24 are respectively screw-coupled, are respectively provided to the sliders 25 so as to move horizontally.

The slide rail 23 formed on the lower housing 16 is formed as a vertical surface on the whole such that even though the slider 25, which is lifted or lowered according to the rotation of the mounting bolt 24, moves vertically, the pump can be clamped on the front surface of the bathtub 11.

However, in order to minimize the size of a hole 11*a* formed in the bathtub 11, it is preferable that the slider 25 is located at an innermost position when the slider 25 is at the bottom dead point and then moves outwards as the slider 25 by the idling of the mounting bolt 24.

To this end, according to the first embodiment of the present invention, each of the slider rails 23, which is formed on the lower housing 16, has a concave groove portion formed at the bottom dead point thereof and the concave groove portion has an upwardly inclined surface 23*a*, and the slider 25 has a horizontally elongated hole 25*a* and an inclined surface 25*b* corresponding to the inclined surface 23*a* of the concave groove portion, such that the slider 25 can horizontally move through the compression of a spring member 31 in association with the movement of the slider holder 26, which is screw-coupled with the mounting bolt.

Herein, if the slider holder 26, which is provided to the slider 25 so as to horizontally move in association with the vertical movement of the slider 25, is elastically mounted by means of the elastic member 31, then the slider 25 can move smoothly in the horizontal direction in association with the vertical movement of the slider holder 26 when the mounting bolt 24 is idled.

The slider rail 23 has one pair of guide rails 32 formed at both sides thereof so as to guide the slider 25 such that the slider 25 is lifted or lowered without escape.

Figure 9:
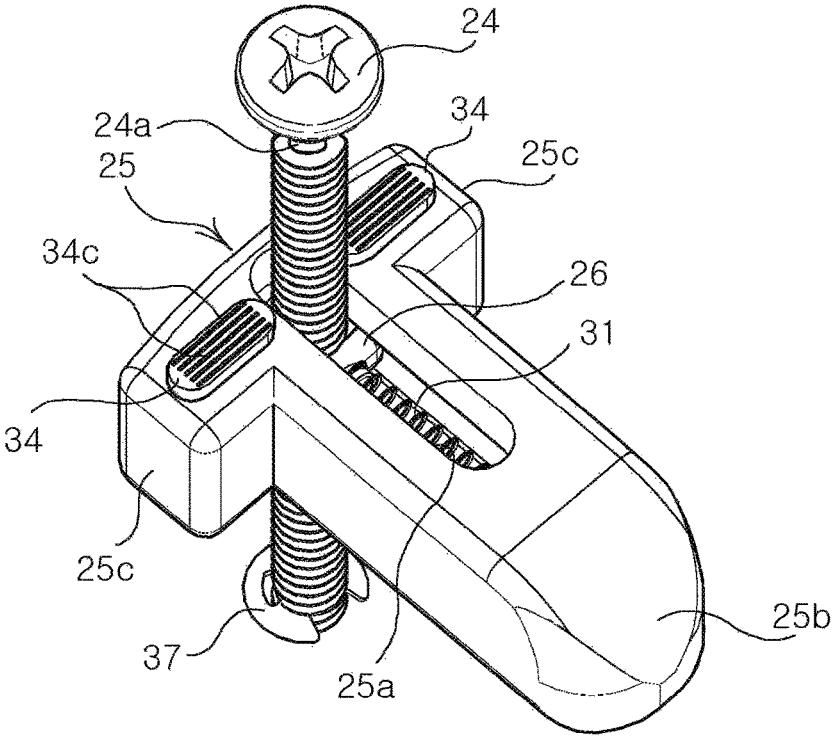
FIG. 9 is a perspective view showing a state, in which a mounting bolt is assembled into the slider according to the present invention.
Figure 10A:
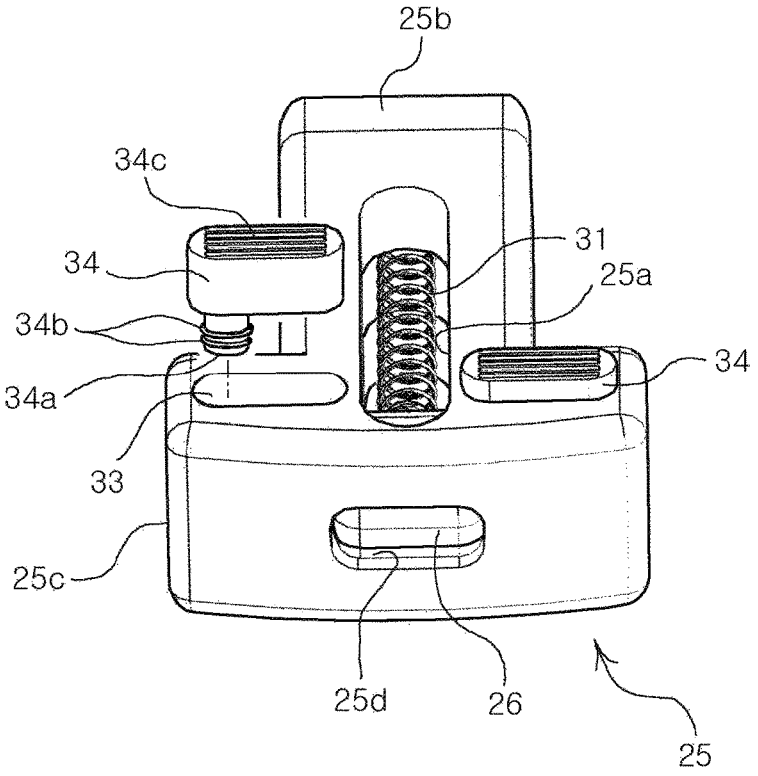
FIG. 10*a* and FIG. 10*b* are perspective views for showing states, in which a slider foot is disassembled from the slider according to the present invention.
Figure 10B:
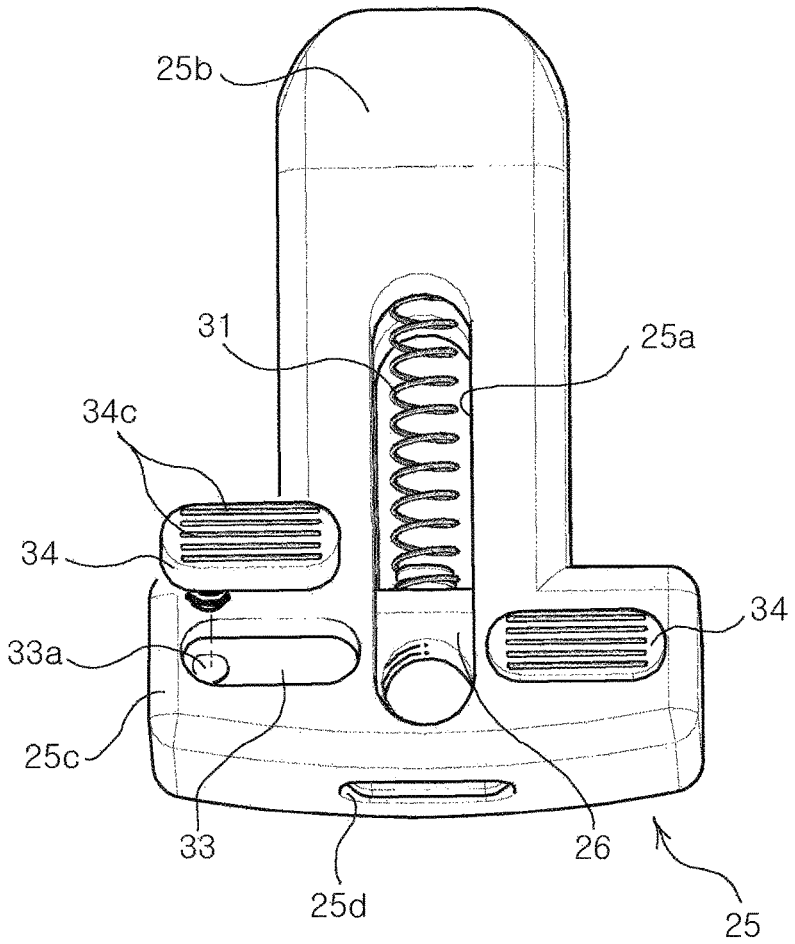

FIG. 9 is a perspective view showing a state, in which the mounting bolt is assembled into the slider according to the present invention, and FIG. 10*a* and FIG. 10*b* are perspective views for showing states, in which slider foot is disassembled from the slider according to the present invention. Referring to FIG. 9 and FIGS. 10*a* and 10*b*, each of the sliders 25 further has extension parts 25*c* formed at both sides of one end thereof and indented grooves 33 formed at both sides on the top surface of the one end, wherein each of the indented grooves 33 is provided with a slider foot 34 to be connected to one surface of the bathtub 11.

In order to mechanically assemble the slider feet 34 into the indented grooves 33 formed on the slider 25, fixing holes 33 are formed in the indented grooves 33, which are formed at both sides on the top surface of the slider 25, and protruded fitting parts 34*a* are formed on the bottom surfaces of the slider feet 34 such that the protruded fitting parts 34*a* are fitted into the fixing holes 33*a*.

Herein, at least one or more annular protrusions 34*b* are formed on the circumferential surfaces of the protruded fitting parts 34*a*, which are formed on the slider feet 34, so as to be forcedly fitted into the fixing holes 33*a*, and at least one or more concave and convex parts 34*c* are further formed on the top surfaces of the slider feet 34.

Accordingly, it is possible to more stably fix the slider feet 34 to the slider 25 and maintain the more stable state rather than when the slider feet 34 are connected to the rear surface of the bathtub 11.

In addition, an insertion hole 25*d* is formed in one surface of the slider 25 such that the slider holder 26 can be inserted into the slider 25 through the insertion hole 25*d*.

A non-thread part 24*a* is formed at the lower portion of the head part of the mounting bolt 24 such that a washer 35 and an O-ring 36 are fitted on the non-thread part 24*a* in sequence.

Furthermore, a stator 37 such as a snap ring is held on the lower end of the mounting bolt 24, which is exposed to the lower flange 16*b* of the lower housing 16, so as to support the mounting bolt 24.

Figure 7:
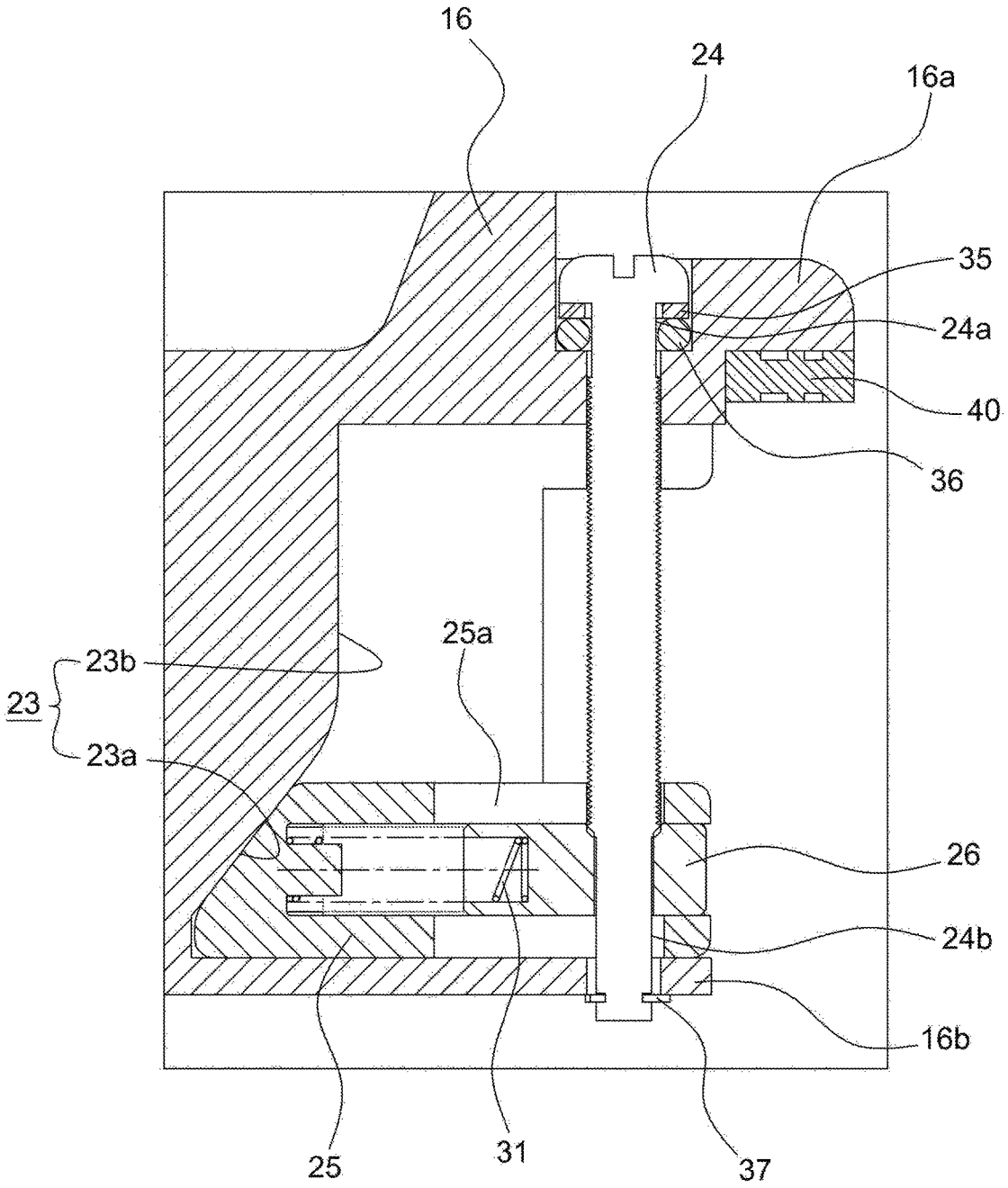
FIG. 7 is a cross-sectional view showing a slider-mounted state according to a second embodiment of the present invention.

FIG. 7 is a cross-sectional view showing a slider-mounted state according to a second embodiment of the present invention. Referring to FIG. 7, the second embodiment only differs from the first embodiment in that another non-thread part 24*b* is further formed on the mounting bolt 24 from the lower portion of the mounting bolt 24 to a position, at which the mounting bolt 24 comes into contact with the top surface of the slider holder 26 coupled to the slider 25, such that the mounting bolt 24 idles when the slider 25 is at the bottom dead point thereof.

This is to prevent the escape of the stator 37 such as a snap ring, which supports the mounting bolt 24, or the damage to the mounting bolt 24 and the like due to the rotation of the mounting bolt 24 when a worker does not recognize whether the slider 25 reaches the bottom dead point and continuously rotates the mounting bolt 24 in a state, in which the slider 25 is positioned at the bottom dead point thereof.

Figure 11A:
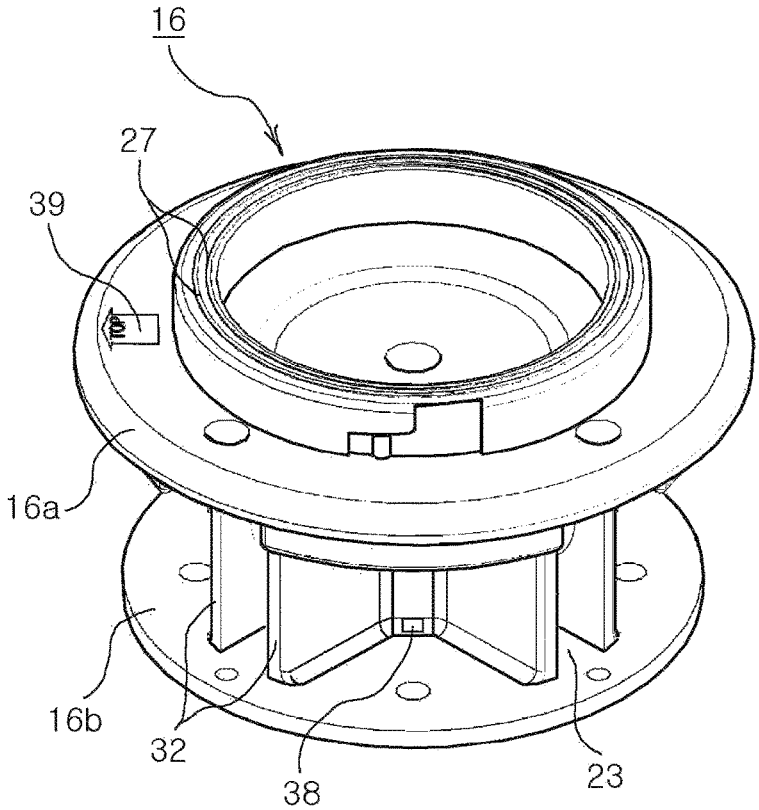
FIG. 11*a* and FIG. 11*b* are respectively a perspective view and a bottom view respectively showing the lower housing according to the present invention.
Figure 11B:
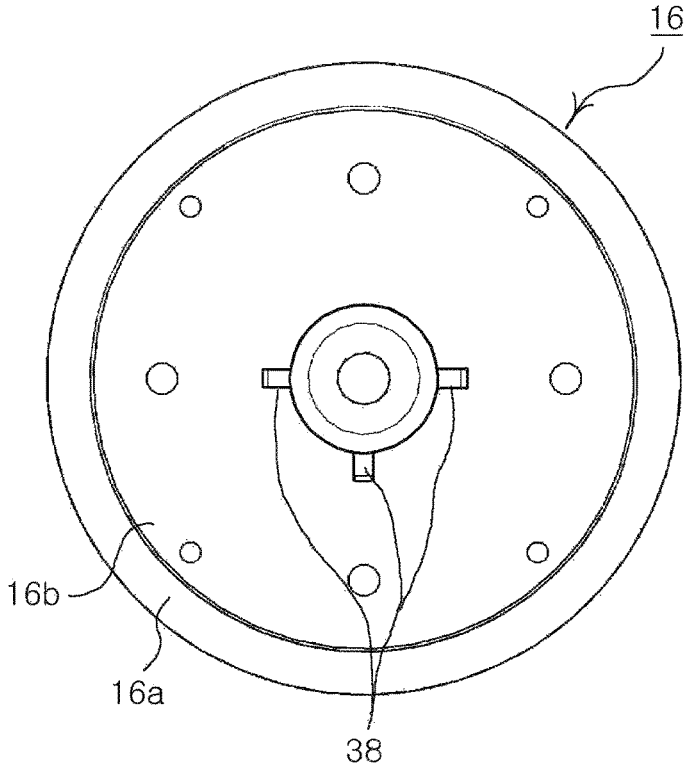

FIG. 11*a* and FIG. 11*b* are respectively a perspective view and a bottom view respectively showing the lower housing according to the present invention. Referring to FIG. 11*a* and FIG. 11*b*, at least one or more drain holes 38 are formed in the lower housing 16. Referring to FIG. 11*a*, which shows the first embodiment of the present invention, the drain holes 38 are formed at three positions with a phase difference of 90°, wherein the remaining one position of such a phase difference, which resides at the upper portion of the lower housing 16, is not provided with the drain hole 38 but is provided with a marking part 39. Therefore, it is possible to easily recognize the portion having no drain hole 38 with a naked eye by means of the marking part 39 and locate the pump in such a manner that the portion of the pump, where the drain hole 38 is not formed, can be placed at an upper side when providing the pump to the bathtub.

Among the reference symbols, which are shown in the drawings but not explained hereinabove, reference symbol 40 represents a packing placed on the bottom surface of the upper flange, reference symbol 41 represents an impeller holder for fixing the impeller to a shaft, and reference symbol 42 represents a mechanical seal for maintaining airtightness with respect to the shaft.

Now, the operations of the whirlpool spa motor pump of a whirlpool massage bathtub, configured as above according to the present invention, will be described in detail hereinafter.

Figure 13A:
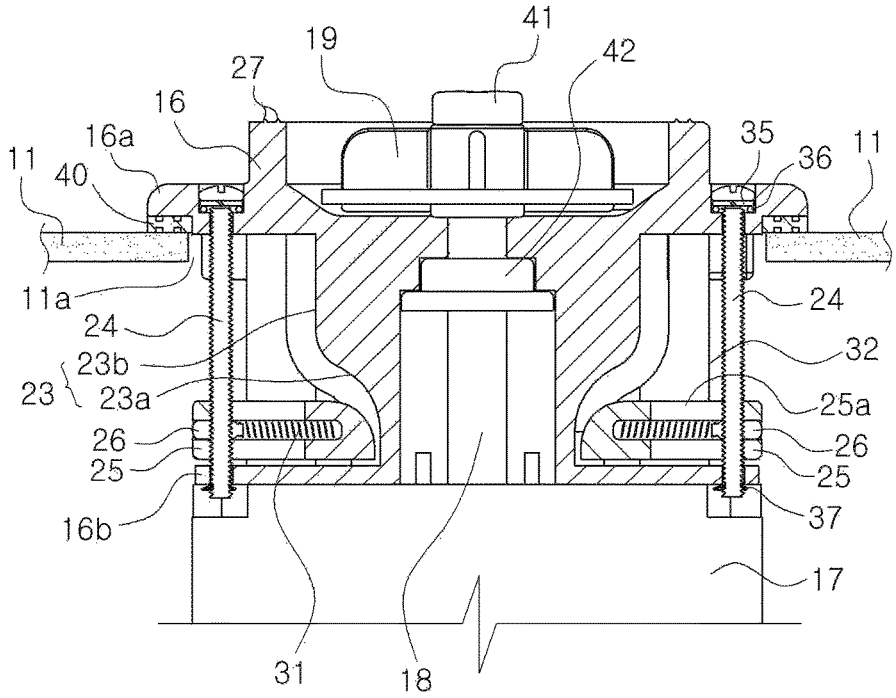
FIG. 13*a* to FIG. 13*c* are cross-sectional views for explaining the clamping of the slider by idling the mounting bolt in the present invention.

First, referring to FIG. 13*a*, the slider 25 is positioned on the concave groove portion, that is the bottom dead point on the slider rail 23 in a state, in which the pump is not provided to the bathtub 11 and the upper housing 20 is separated from the lower housing 16.

Accordingly, the slider holder 26 screw-coupled with the mounting bolt 24 is positioned at an outermost position in FIG. 13*a*, wherein the slider 25 elastically mounted by means of the elastic member 31 such as a coil spring is not protruded to the outside.

According to the present invention as above, the slider 25 is positioned at the innermost position thereof before mounting the pump to the bathtub 11 and thus the hole 11*a* of the bathtub 11 is formed of a size just enough to pass the lower flange 16 therethrough. Therefore, the present invention has an advantage of minimizing the size of the hole 11*a*.

In the state, where the marking part 39 formed on the lower housing 16 is positioned at an upper side, the pump of the present invention is adjusted to be consistent with the hole 11*a* of the bathtub 11 in the bathtub 11 and then is pushed through the hole 11*a* such that the packing 40 mounted on the one surface of the upper flange 16*a* is connected to the inner surface of the bathtub 11.

Figure 13B:
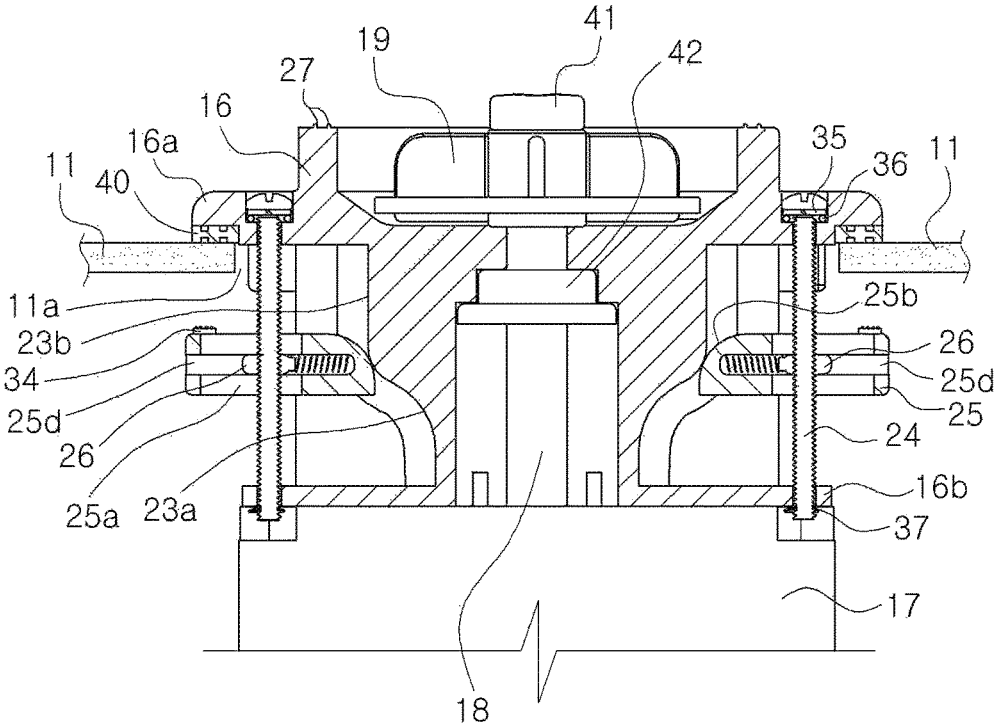

In this state, if the mounting bolt 24 exposed to the outside of the upper flange 16*a* is idled using a tool 43 such as a driver and the like, then the slider 25 is gradually moved towards the upper flange 16*a* side as shown in FIG. 13*b* since the slider holder 26 is screw-coupled with the mounting bolt 24 and the slider 25 is elastically mounted by the elastic member 31 on the slider holder 26.

However, in the case of the mounting bolt 24 according to the second embodiment of the present invention as shown in FIG. 7, the thread portion of the slider holder 26, which is coupled with the slider holder 26, is not engaged with the thread portion of the mounting bolt 24. Therefore, even though the mounting bolt 24 is rotated by negligence in the counterclockwise direction, the slider 25 is not lowered but just the mounting bolt 24 idles.

However, if a worker presses the mounting bolt 24 downwards by using a tool such as a driver, the O-ring made from a rubber material and mounted on the bottom surface of the head part of the mounting bolt 24 is compressed and the mounting bolt 24 is lowered such that the thread portion of the mounting bolt 24 is engaged with the thread portion of the slider holder 26.

If the mounting bolt 24 is rotated in the clockwise direction in this state, where the thread portion of the mounting bolt 24 is engaged with the thread portion of the slider holder 26, the slider 25 is gradually moved towards the upper flange 16*a* side, as mentioned above with respect to the first embodiment. In the above operation, since the concave groove portion has the upwardly inclined surface 23*a* and the front end of the slider 25 also has the inclined surface 25*b*, the slider 25 is pushed by the inclined surface 23*a* and gradually moved outwards while compressing the elastic member 31, when the slider holder 26 moves towards the upper flange 16*a* side.

As described above, the outward movement operation of the slider 25 can be continued until the front end of the slider 25 reaches the vertical surface 23*b* of the slider rail 23, because the slider 25 is formed with the horizontally elongated hole 25*a*, through which the mounting bolt 24 passes.

The slider 25 moves outwards while the slider holder 26 screw-coupled with the mounting bolt 24 has no change in position such that the elastic member 31 is compressed by the slider 25.

Figure 13C:
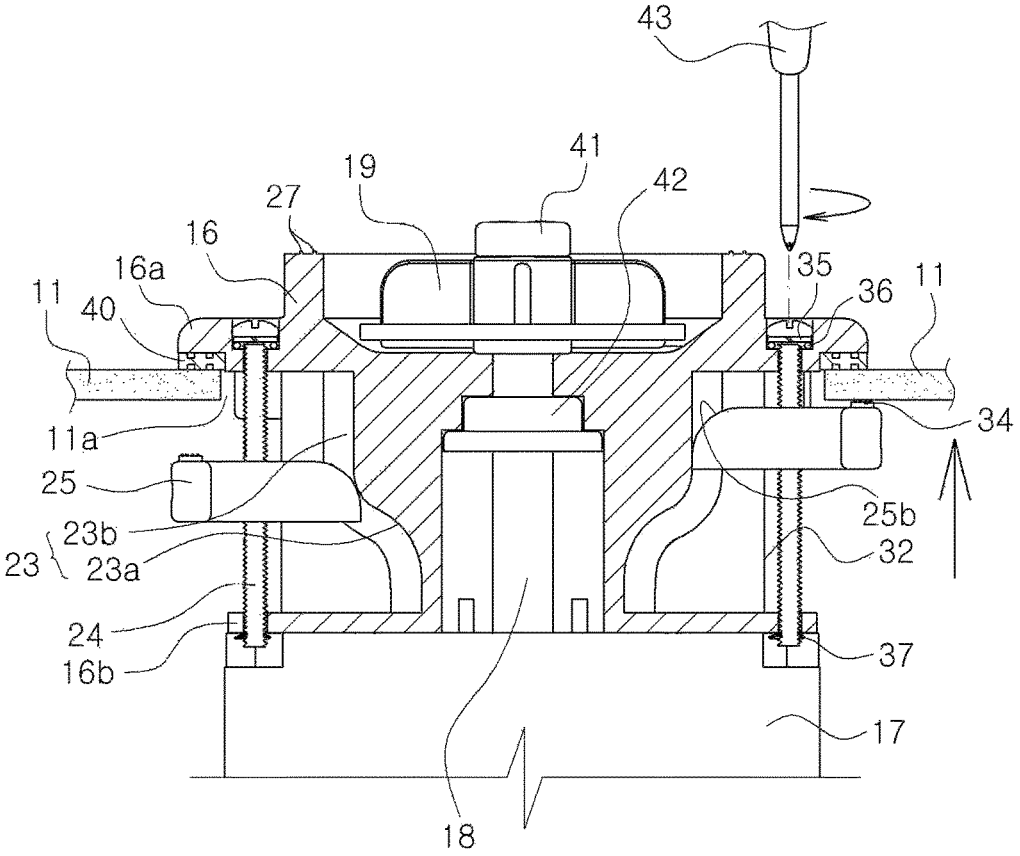

If the slider feet 34 mounted on the top surface of the slider 25 come into close contact with the bottom surface of the bathtub 11 due to the continuous idling of the mounting bolt 24, as shown in FIG. 13*c*, then the clamping by the slider 25 is finished. Therefore, this operation is carried out with respect to all the mounting bolts 24, which are mounted on the lower housing 16 so as to idle, such that the mounting work of the lower housing 16 is finished as the slider feet 34 mounted on the top surfaces of the sliders 25 are strongly clamped to the rear surface of the bathtub 11.

After mounting the lower housing 16 to the bathtub 11 as described above, the upper housing 20 is coupled with the lower housing 16 by rotating the upper housing 20 in the clockwise direction in a state, in which the coupling protrusions 29 formed on the inner surface of the upper housing 20 are in consistent with the coupling grooves 28 formed on the lower housing 16, wherein the coupling protrusions 29 pass the holding protrusions 30 formed on the coupling groove 28 and then finally coupled in the coupling grooves 28. Herein, at least one or more of the sealing rings 27 are formed on the top surface of the lower housing 16 so as to maintain airtightness between the lower housing 16 and the upper housing 20.

Therefore, if the impeller 19 fixed by the impeller holder 41 on the shaft 18 is rotated by the operation of the motor 17, the water in the bathtub is sucked into the pump through the suction holes 21 formed in the center of the upper housing 20 and collides with the inner wall of the upper and lower housings 16 and 20. Then, the water is discharged with high pressure together with bubbles to the inside of the bathtub through the discharge holes 22 so as to hit the skin of a user, thereby simultaneously providing the massage effect and skin care effect by using the water.

If the pump is used for a long time in the above-mentioned manner, the mechanical seal 42 for maintaining the airtightness of the shaft 18 is likely to be worn, resulting in the leakage of water between the mechanical seal 42 and the shaft 18.

Figure 12:
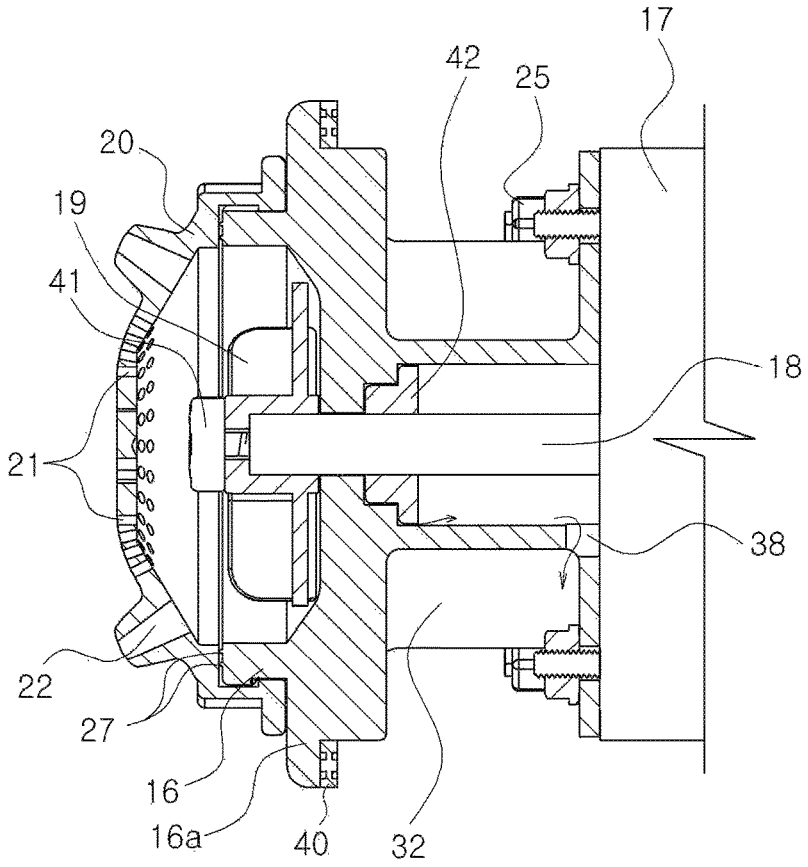
FIG. 12 is a view showing a state, in which water leaked into the lower housing is drained to the outside in the present invention.

However, according to the present invention, as shown in FIG. 11*a* and FIG. 11*b*, the lower housing 16 is formed with at least one or more of the drain holes 38 such that the water leaked between the shaft 18 and the mechanical seal 42 is discharged to the outside through the drain holes 38 along the directions indicated by arrows in FIG. 12, thereby preventing the electric shock due to the water leakage beforehand.

Meanwhile, if the pump has to be separated from the bathtub 11 because of motor burning, parts replacement and the like during the use of the pump, the upper housing 20 is rotated in the counterclockwise direction so as to be separated from the lower housing 16. Then, the mounting bolt 24 exposed to the outside from the lower housing 16 is rotated in the counterclockwise direction. Thus, the slider holder 26 coupled with the slider 25 is lowered in the opposite manner from the above-mentioned assembling work, such that the clamping by the slider feet 34 is released.

If the slider holder 26 reaches the bottom dead point and the slider 25 is positioned on the concave groove portion by the continuous rotation of the mounting bolt 24, the slider 25 is positioned at the innermost position by the restoring force of the elastic member 31, wherein all the above operations are carried out by rotating the mounting bolt 24 in the counterclockwise direction.

According to the first embodiment of the present invention, in which the clamping state by the slider feet 34 is released by the above operations, the stator 37 such as a snap ring, which supports the mounting bolt 24, is likely to escape or, in a serious case, the mounting bolt 24 may be damaged, since excessive force is applied to the lower flange 16*b* of the lower housing 16 if a worker continuously rotates the mounting bolt 24 in a state, in which the slider 25 is positioned at the bottom dead point thereof. Therefore, in order to prevent the above possible problems, the worker should pay attention to the rotation of the mounting bolt 24.

However, according to the second embodiment of the present invention, in which the non-thread part 24*b* is further formed on the position of the mounting bolt 24, as shown in FIG. 7, the thread portion of the slider holder 26 is separated from the thread portion of the mounting bolt 24 if the slider 25 reaches the bottom dead point by the counterclockwise rotation of the mounting bolt 24. Therefore, even though the mounting bolt 24 is continuously rotated by negligence in the counterclockwise direction, the slider holder 26 idles on the mounting bolt 24 and thus no force is applied to the lower flange 16*a* of the lower housing 16. Accordingly, it is possible to prevent the escape of the stator 37 such as a snap ring, which supports the mounting bolt 24, from the mounting bolt 24, or the damage to the mounting bolt 24 and the like beforehand.

As mentioned hereinabove, all the sliders 25 are accommodated in the concave groove portions simultaneously with the releasing of the clamping by the slider feet 34, and then the pump can be separated from the bathtub by pulling the lower housing 16 towards the worker. Therefore, the pump can be re-assembled into the bathtub in the above-mentioned assembling work after required repair and the like.

As described above, while the present invention has been particularly shown and described with reference to the example embodiments thereof, it will be understood by a person skilled in the art that the present invention could be implemented in any other specific forms without changing the technical idea or essential features thereof. Therefore, the described embodiments are to be considered in all respects only as illustrative and not restrictive, the scope of the invention is indicated by the appended claims rather than by the foregoing description, and all changes which come within the meaning and range of equivalency of the claims are to be embraced within their scope.

What is claimed is:

1. A whirlpool spa motor pump of a whirlpool massage bathtub, comprising:

a lower housing having an upper flange and a lower flange;

an impeller for rotating by a motor, which is provided to the lower housing, so as to generate suction force;

an upper housing coupled to an upper portion of the lower housing by a coupling means and having suction holes and discharge holes;

two or more slider rails vertically provided on the outside of the lower housing;

a mounting bolt provided to the upper and lower flanges so as to be positioned at one side of the slider rail;

a slider fitted with the mounting bolt; and a slider holder inserted into the slider so as to be screw-coupled with the mounting bolt.

2. The whirlpool spa motor pump of a whirlpool massage bathtub according to claim 1, wherein each of the slider rails has an upwardly inclined surface formed on a concave groove portion at the lower part thereof and each of the sliders has a horizontally elongated hole and an inclined surface corresponding to the inclined surface of the concave groove portion such that the slider can horizontally move by the slider holder, which is screw-coupled with the mounting bolt.

3. The whirlpool spa motor pump of a whirlpool massage bathtub according to claim 2, wherein the slider is elastically provided to the slider holder by an elastic member so as to be horizontally moved on the slider holder.

4. The whirlpool spa motor pump of a whirlpool massage bathtub according to claim 1, wherein one pair of guide rails are formed at both sides of the slider rail so as to guide the lifting and lowering of the slider.

5. The whirlpool spa motor pump of a whirlpool massage bathtub according to claim 1, wherein extension parts are further formed at both sides of one end of the slider.

6. The whirlpool spa motor pump of a whirlpool massage bathtub according to claim 1, wherein an insertion hole is further formed in one surface of the slider such that the slider holder is inserted into the insertion hole.

7. The whirlpool spa motor pump of a whirlpool massage bathtub according to claim 1, wherein indented grooves are formed at both sides on the top surface of the slider such that slider feet are provided to the indented grooves.

8. The whirlpool spa motor pump of a whirlpool massage bathtub according to claim 7, wherein fixing holes are formed in the indented grooves, which are formed at both sides on the top surface of the slider, and protruded fitting parts are formed on the bottom surfaces of the slider feet such that the protruded fitting parts are fitted into the fixing holes.

9. The whirlpool spa motor pump of a whirlpool massage bathtub according to claim 8, wherein at least one or more annular protrusions are formed on the protruded fitting parts, which are formed on the slider feet, so as to be forcedly fitted into the fixing holes.

10. The whirlpool spa motor pump of a whirlpool massage bathtub according to claim 7, wherein at least one or more concave and convex parts are further formed on the top surfaces of the slider feet.

11. The whirlpool spa motor pump of a whirlpool massage bathtub according to claim 1, wherein a non-thread part is formed at the lower portion of the head part of the mounting bolt such that a washer and an O-ring are fitted on the non-thread part in sequence.

12. The whirlpool spa motor pump of a whirlpool massage bathtub according to claim 1, wherein another non-thread part is further formed from the lower portion of the mounting bolt to a position, at which the mounting bolt comes into contact with the top surface of the slider holder coupled to the slider, such that the mounting bolt idles when the slider is at the bottom dead point thereof.

13. The whirlpool spa motor pump of a whirlpool massage bathtub according to claim 12, wherein a stator is held on the lower end of the mounting bolt, which is exposed to the lower flange of the lower housing, so as to support the mounting bolt.

14. The whirlpool spa motor pump of a whirlpool massage bathtub according to claim 1, wherein at least one or more drain holes are formed in the lower housing.

15. The whirlpool spa motor pump of a whirlpool massage bathtub according to claim 14, wherein the lower housing has a portion, which is positioned at an upper side and in which any drain hole is not formed, and a marking part is indicated on the portion of the lower housing, in which any drain hole is not formed.

16. The whirlpool spa motor pump of a whirlpool massage bathtub according to claim 1, wherein at least one or more sealing rings are formed on the top surface of the lower housing so as to maintain the airtightness with respect to the upper housing.

* * * * *